United States Patent [19]

Shannon, Sr.

[11] Patent Number: 4,926,685

[45] Date of Patent: May 22, 1990

[54] ADJUSTABLE CRIMPING TOOL

[76] Inventor: John K. Shannon, Sr., 2000 S. Vincennes Cir., Racine, Wis. 53402

[21] Appl. No.: 409,100

[22] Filed: Sep. 19, 1989

[51] Int. Cl.[5] ..... B21D 7/06

[52] U.S. Cl. ..... 72/410; 72/413; 29/751; 81/422; 81/424; 403/4; 403/84; 403/383

[58] Field of Search ..... 72/410, 409, 413, 416, 72/473, 477, 482; 81/422, 421, 418, 423, 385, 180.1, 178, 185.2, 186, 440, 424; 29/751, 758, 268; 403/104, 106, 83, 84, 4, 383

[56] References Cited

U.S. PATENT DOCUMENTS

| | | | |
|---|---|---|---|
| 1,110,528 | 9/1914 | Borreson | 81/424 |
| 1,500,314 | 7/1924 | Hacheney | 81/178 |
| 1,805,298 | 5/1931 | Schweigert | 81/186 |
| 2,713,279 | 7/1955 | Harris | 72/409 |
| 3,345,856 | 10/1967 | Werner et al. | 72/410 |

FOREIGN PATENT DOCUMENTS

| | | | |
|---|---|---|---|
| 2841588 | 3/1980 | Fed. Rep. of Germany | 72/410 |
| 1115952 | 5/1956 | France | 29/751 |
| 1262200 | 2/1972 | United Kingdom | 403/4 |

*Primary Examiner*—Daniel C. Crane

*Attorney, Agent, or Firm*—Peter N. Jansson, Ltd.

[57] ABSTRACT

An improved adjustable crimping tool having jaws each with a die wheel, each jaw and die wheel having aligned non-round apertures therethrough, and for each jaw and die wheel an axle through the non-round apertures having axially aligned first and second portions selectively engageable with the non-round apertures, the jaw and die wheel non-rotatable on the first portion and rotatable on the second portion.

20 Claims, 2 Drawing Sheets

ADJUSTABLE CRIMPING TOOL

FIELD OF THE INVENTION

This invention is related generally to tools for crimping and, more particularly, to adjustable tools for crimping electrical terminals to cables.

BACKGROUND OF THE INVENTION

Terminals which are to be crimped onto cables each have an open-ended tube-like barrel which slips over the end of a cable in position for crimp fastening. The wall thickness of the barrel is critical and is commensurate with the strength and ductility of the material used for the barrel.

Such crimp terminals are offered in various gauge sizes (diameters) to accommodate various cable gauges. Crimping tools typically have crimping dies, that is, the portions engaging and deforming the crimp terminals, which can accommodate several different (usually 6–10) terminal barrel sizes. The dies, which usually come in facing pairs, are mounted on compound leveraged jaws and are brought together against opposite sides of the the barrel. This action crushes the crimp terminal against the cable, to secure the crimp terminal to the cable.

In crimping tools which are adjustable for barrels of different sizes, the crimping dies are adjustably connected to their respective jaws. The dies typically accommodate different barrel sizes by having different configurations (profiles of different sizes) along different portions of their edges. The orientation of a die in its respective jaw determines which portion of the die is facing the opposed jaw and die, and thus in position for crimping.

In prior crimping tools of this type, adjustable connection of such dies to their respective jaws has been accomplished in several different ways. Each of these ways has certain problems and disadvantages.

Some dies are loosely fitted into pockets on the jaws, such that they may either be readily removed and reinserted in a different orientation, or replaced with another die. This sort of adjustable die-in-jaw connection obviously involves loose dies, with the attendant problems of lost dies and sometimes time-consuming adjustment procedures.

A more favored adjustable connection utilizes as die members a pair of tool steel wheels with varying hexagonal or diamond-shaped die notches about their perimeters, such notches being sized to crimp terminals of specific gauge sizes. Each such die wheel is rotated on an axle mounted on its respective jaw in an orientation perpendicular to the plane of jaw motion. Such axle typically extends between a pair of parallel plates spaced from one another enough to accommodate the die wheel.

To crimp a certain size terminal, the die wheels on the two jaws are rotated until the notches of size appropriate for such terminal are in opposed positions, that is, are facing one another. The jaws are then opened so that the terminal can be placed between such opposed notches. Then the jaws are closed to cause the dies to crimp the terminal.

During such crimping action, die wheels have a tendency to rotate. If such die rotation is not restrained, the dies cannot be brought together squarely and defective crimps may result.

One device used to cage such die wheels includes, for each die wheel, a retractable pin member mounted to the jaw in a position which is offset from the axle on which the die wheel turns. Such retractable pin member is part of a rigid assembly which includes the axle on which the die wheel turns; the pin member is parallel to and radially offset from the axle. Such pin member is positioned to engage (slide into) a selected locating hole on the face of the die wheel and into an aligned hole or holes in the parallel plates which form the jaw.

Another device of the prior art for caging such die wheels has a retractable flat member which slides through slots in the jaw plates to engage the perimeter of the die wheel in a way making rotation impossible until disengagement of such flat member from the die wheel perimeter. These devices typically have springs biasing the retractable members toward their engaged positions.

These sorts of caging systems work well when everything is in alignment. However, these retractable pin and flat members have a definite tendency to bind, which can make disengagement and adjustment somewhat difficult. This problem is exacerbated by the misalignment which can occur from abuse, from high crimping pressures, and from ordinary wear. With either of these two systems for caging the die wheels, the sliding mechanism often fails to slide properly into position. And, the crimping pressure can bend or break the relatively fragile caging mechanism.

Still another drawback to such caging systems of the prior art is that they involve several parts, and because of this are rather expensive constructions. There is a clear need for an improved adjustable crimping tool.

OBJECTS OF THE INVENTION

It is an object of this invention to provide an improved adjustable crimping tool which overcomes the problems and shortcomings of the prior art, including those mentioned above.

Another object of this invention is to provide an improved crimping tool which may be adjusted more quickly and easily than crimping tools of the prior art.

Another object of this invention is to provide a crimping tool which may be adjusted easily even after significant use and abuse of the crimping tool.

Still another object of this invention is to provide a crimping tool which is less susceptible to part breakage.

Another object of this invention is to provide a crimping tool with fewer parts than in certain devices of the prior art and which is inexpensive in construction.

These and other important objects will be apparent from the descriptions of this invention which follow.

SUMMARY OF THE INVENTION

This invention is an improved adjustable crimping tool for crimping terminals onto cable. The adjustable crimping tool of this invention overcomes certain problems of the prior art, including those described above.

The invention allows quick and easy adjustment for terminals and cables of varying sizes. Such ease and speed of adjustment continues even after significant use and abuse of the tool. The inventive tool is less susceptible to part breakage than certain crimping tools of the prior art. And, even with these advantages the adjustable crimping tool of this invention is simple and inexpensive in construction.

The adjustable crimping tool of this invention is of the general type having at least one jaw, and preferably a pair of opposed jaws, a die wheel for each jaw, such die wheel being rotatably mounted on the jaw to selectively expose die portions with different profiles, and means to secure the die wheel in selected position. The invention is characterized by the jaw and die wheel having aligned non-round apertures through them, such apertures receiving an axle which has axially aligned first and second portions of different cross-sectional configurations to either prevent or allow die wheel rotation.

More specifically, the first portion of each axle prevents free rotation of the die wheel thereon and the second portion allows rotation of the die wheel thereon for purposes of die wheel adjustment. The first portion of each axle preferably has a non-round section which allows non-rotatable mating thereof with the non-round apertures of the jaw and die wheel. The second portion of each axle is preferably round and of somewhat reduced dimension to allow free rotation of the die wheel thereon.

Each axle is preferably slideable with respect to its respective jaw and die wheel such that the first and second portions of the axle are selectively engageable into the non-round apertures. Highly preferred embodiments of this invention include a means, such as a coiled spring, to bias the axle first portion toward the non-round apertures.

The non-round apertures are preferably polygonal in shape and the axle first portion has a mating polygonal cross-section. Hexagonal shapes are most preferred. The second portion of the axle preferably has a cross-section which is round and of diameter no greater than the flat-to-flat cross dimension of the non-round apertures. This allows the die wheel to readily turn thereon.

In highly preferred embodiments, each jaw has a pair of parallel plates spaced to provide a cage in which the die wheel is supported. The non-round apertures are in each of such plates, and the axle extends through both plates.

In some cases a single jaw can be leveraged such that the die wheel thereon bears against a non-adjustable member to perform the crimping operation. However, a pair of opposed leveraged jaws, each of which is a mirror image of the other, is preferably used.

The structure of this invention is simpler than prior devices, with their offset locking mechanisms for preventing rotation of die wheels during crimping. In highly preferred embodiments of this invention each axle is firmly held in assembly with the jaw plates and die wheel simply by means of snap rings at either end of the axle.

DETAILED DESCRIPTIONS OF PREFERRED EMBODIMENTS

Figure 1:
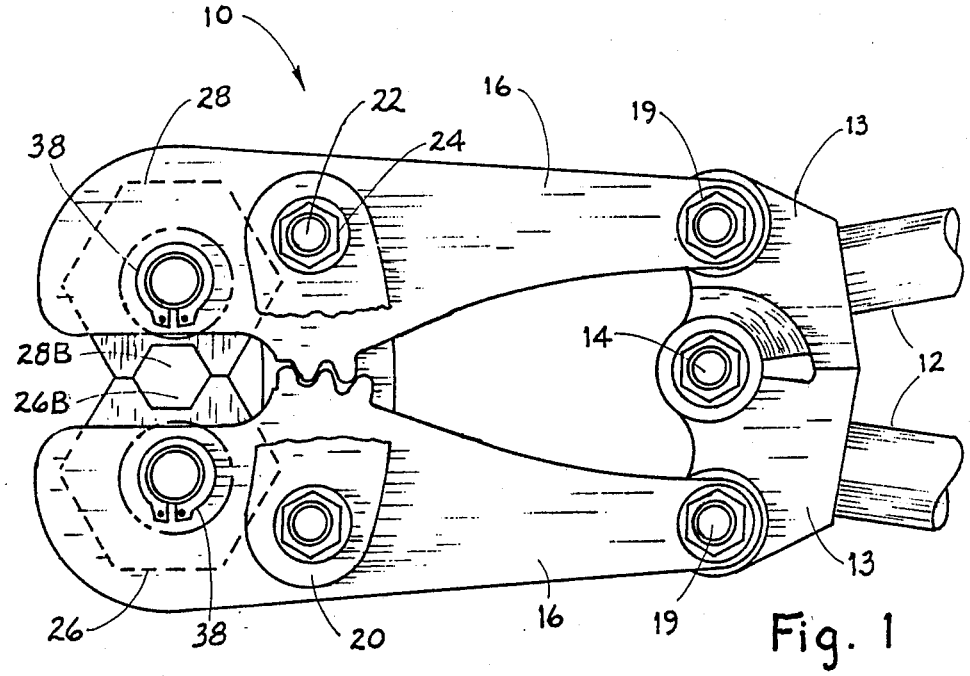
FIG. 1 is a fragmentary front elevation of an improved adjustable crimping tool in accordance with this invention.
Figure 2:
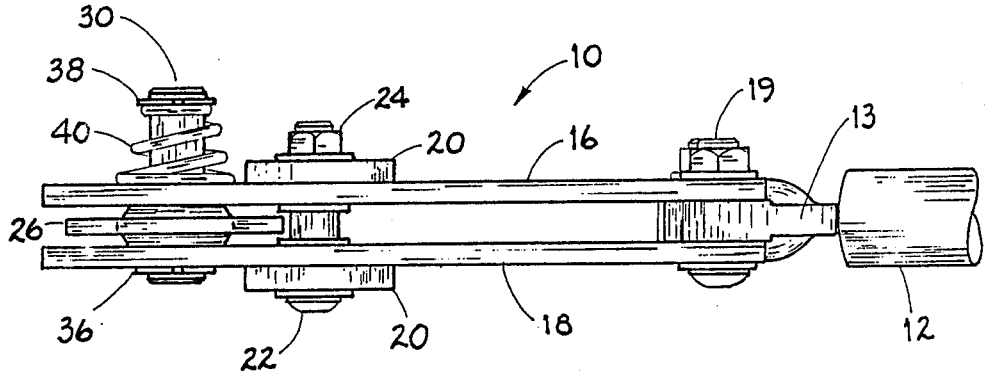
FIG. 2 is a bottom view of FIG. 1.

The drawings illustrate an adjustable crimping tool 10 in accordance with this invention. Crimping tool 10 has opposed handles 12, end plates 13 at the proximal ends of handles 12 and rigidly attached thereto, and a pair of mirror-image leveraged jaws with attached parts as hereafter described. Handles 12 are hinged together by hinge 14, and crimping is carried out by squeezing such handles together as in devices of the prior art.

Each of the two jaws has first and second parallel jaw plates 16 and 18. The jaw plates 16 and 18 of each jaw are attached to one end plate 13 by means of a bolt 19. A pair of tie bars 20 extend between the jaws and are attached thereto by tie bar bolts and nuts 22 and 24.

Die wheels 26 and 28 are sandwiched between respective pairs of first and second jaw plates 16 and 18 such that they are supported in opposed relationship. Around the peripheries of die wheels 26 and 28 are notches of various sizes and shapes, chosen to accept terminals and cables of various sizes for crimping. This is illustrated best in FIG. 3; in FIG. 1 opposed notches 26B and 28B of die wheels 26 and 28, in position for use, are seen, while simple unshaped dotted lines represent the die wheel peripheral portions which are behind first jaw plates 16 and not rotated to the inwardly-facing position of use. Each is held on an axle 30.

Figure 3:
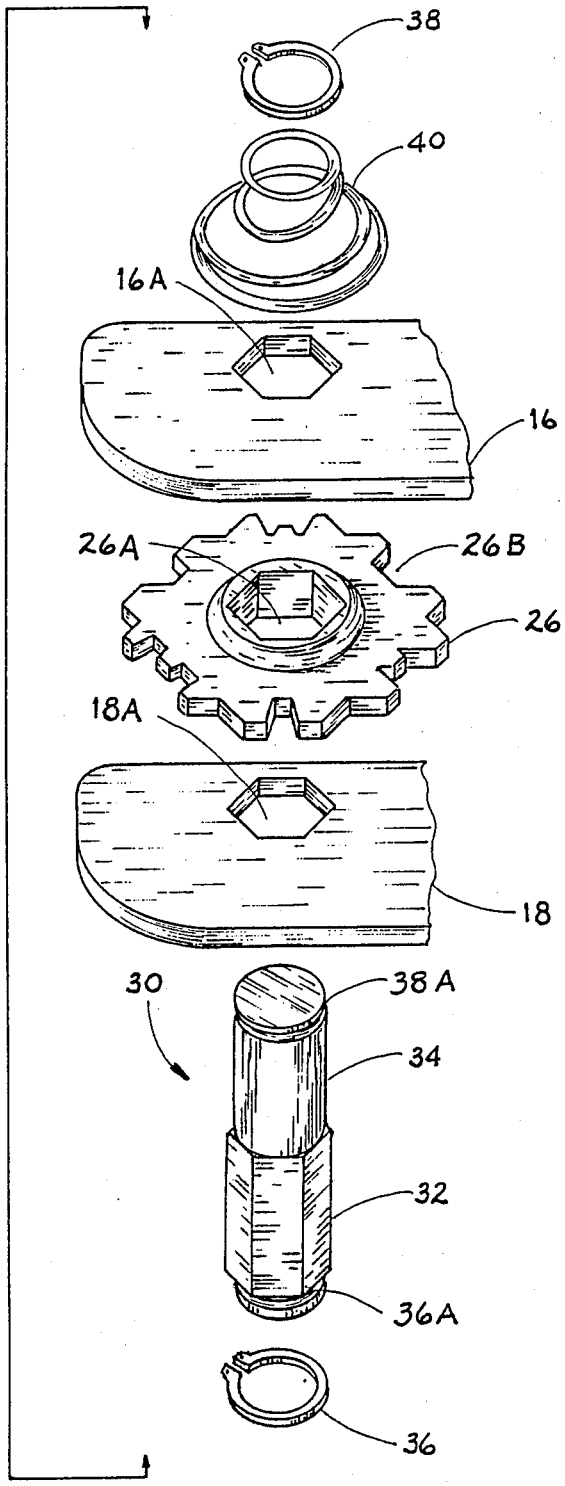
FIG. 3 is a fragmentary exploded perspective view.

The exploded view of FIG. 3, which illustrates a single jaw and its related parts, shows the details of this invention most clearly. First and second jaw plates 16 and 18 have hexagonal apertures 16A and 18A, respectively. Die wheel 26 has a similar hexagonal aperture 26A. Hexagonal apertures 16A, 18A and 26A are axially aligned with one another.

Each of the axles 30 has a first portion 32 of hexagonal cross-section which mates with hexagonal aperture 16A, 18A and 26A. Axle 30 also has a second portion 34, in axial alignment with first portion 32 and immediately adjacent thereto, which has a round cross-section. The diameter of such round cross-section is equal to the flat-to-flat cross-dimension of the hexagonal cross-section of first portion 32.

Thus, when second portion 34 of axle 30 is brought into contact with the hexagonal apertures 16A, 18A and 26A, axle 30 is free to rotate with respect thereto. This allows rotation of die wheel 26 with respect to axle 30 and with respect to first and second jaw plates 16 and 18. Such rotation allows rotational adjustment of die wheel 26 to expose an edge profile appropriate for the terminal end cable to be crimped together.

Axle 30 is of sufficient length to allow either first portion 32 or second portion 34 to be in contact with all three of the hexagonal apertures 16A, 18A and 26A. Axle 30 can be moved manually to allow rotational adjustment or to prevent rotation. Axles 30 are biased to the non-rotational position, that is, with their hexagonal first portions 32 in contact with hexagonal apertures 16A, 18A and 26A.

Each axle 30 is held in assembly with its respective pair of jaw plates 16 and 18 and with the respective die wheel by means of snap rings 36 and 38. Annular grooves 36A and 38 are at the opposite ends of each axle 30 to receive snap rings 36 and 38, respectively. For each jaw, a coil spring 40 extends between snap ring 38 and first jaw plate 16. Spring 40 is in compression such that it biases axle 30 to the locking, non-rotational position.

The parts of this invention may be made using materials which are well known to those skilled in the art, such as hardened tool steel or the like. A number of variations in design and materials are possible.

While the principles of this invention have been described in connection with specific embodiments, it should be understood clearly that these descriptions are made only by way of example and are not intended to limit the scope of the invention.

I claim:

1. In an adjustable crimping tool of the type having at least one jaw, a die wheel rotatably mounted thereon to selectively expose die portions with different profiles for accepting workpieces of different shapes and/or sizes, and means to secure the die wheel in selected position, the improvement comprising:

the jaw and die wheel each having a non-round aperture therethrough, said apertures being in coaxial alignment;

an axle extending through the non-round apertures with axially aligned first and second portions selectively engageable with the non-round apertures, the jaw and die wheel non-rotatable on the first portion and rotatable on the second portion, said first and second portions being axially movable with respect to both said apertures.

2. The adjustable crimping tool of claim 1 wherein the axle is axially slideable with respect to the jaw and die wheel to removably move the second portion thereof into the non-round apertures.

3. The adjustable crimping tool of claim 1 further including means to bias the axle first portion toward the non-round apertures.

4. The adjustable crimping tool of claim 1 wherein the non-round apertures are polygonal in shape and the axle first portion has a mating polygonal cross-section.

5. The adjustable crimping tool of claim 4 wherein the non-round apertures and first portion cross-section are hexagonal.

6. The adjustable crimping tool of claim 5 wherein the second portion of the axle has a round cross-section of diameter no greater than the flat-to-flat cross dimension of the non-round apertures, such that the die wheel may readily turn thereon.

7. The adjustable crimping tool of claim 1 wherein the at least one jaw comprises a pair of parallel plates spaced to accommodate the die wheel therebetween, both of said plates having said non-round apertures.

8. The adjustable crimping tool of claim 7 wherein the axle is axially slideable with respect to the plates and die wheel to removably move the second portion of the axle into the non-round apertures sufficiently to allow rotation of the die wheel thereon.

9. The adjustable crimping tool of claim 8 further including means to bias the axle first portion toward the non-round apertures.

10. The adjustable crimping tool of claim 9 wherein the non-round apertures are hexagonal in shape and the axle first portion has a mating hexagonal cross-section.

11. The adjustable crimping tool of claim 10 wherein the second portion of the axle has a round cross-section of diameter no greater than the flat-to-flat cross dimension of the hexagonal apertures, such that the die wheel may readily turn thereon.

12. The adjustable crimping tool of claim 1 comprising a pair of said leveraged jaws supporting a pair of die wheels in opposed positions.

13. The adjustable crimping tool of claim 12 wherein each of the jaws comprises a pair of parallel plates spaced to accommodate one of the die wheels therebetween, each of the plates having one of said non-round apertures.

14. The adjustable crimping tool of claim 13 wherein the axle of each jaw is axially slideable with respect to the plates of said jaw and with respect to the die wheel therebetween to removably move the second portion thereof into the non-round apertures of such plates and die wheel.

15. The adjustable crimping tool of claim 14 further including means to bias the axle first portions toward the non-round apertures.

16. The adjustable crimping tool of claim 15 wherein the non-round apertures are polygonal in shape and the axle first portions have mating polygonal cross-sections.

17. The adjustable crimping tool of claim 16 wherein the non-round apertures and first portion cross-sections are hexagonal.

18. The adjustable crimping tool of claim 16 wherein the second portions of the axles have round cross-sections of diameters no greater than the flat-to-flat cross dimensions of the non-round apertures, such that the die wheels may readily turn thereon.

19. In an adjustable crimping tool of the type having a pair of opposed jaws, die wheels rotatably mounted thereon to selectively expose die portions with different profiles for accepting workpieces of different shapes and/or sizes, and means to secure the die wheels in selected position with opposed mirror-imaged die profiles, the improvement comprising:

each jaw and die wheel having a non-round aperture therethrough, said apertures being in coaxial alignment;

an axle extending through the non-round apertures of each jaw and die wheel combination, each axle having axially aligned first and second portions selectively engageable with the non-round apertures, the die wheel non-rotatable on the first portion to secure the die wheel in selected position and rotatable on the second portion to allow die wheel rotation on the axle for purposes of die profile selection, said first and second portions being axially movable with respect to both said apertures.

20. The adjustable crimping tool of claim 19 wherein:

each jaw has a pair of parallel spaced plates accommodating said die wheel therebetween; and each axle has a snap ring at its opposite ends to maintain it in assembly with the parallel plates and the die wheel therebetween.

* * * * *